United States Patent [19]

Pollari

[11] Patent Number: 4,637,778

[45] Date of Patent: Jan. 20, 1987

[54] SELF-PRIMING DIFFUSER TYPE CENTRIFUGAL PUMP

[75] Inventor: Theodore J. Pollari, Ft. Mill, N.C.

[73] Assignee: Textron Inc., Providence, R.I.

[21] Appl. No.: 560,502

[22] Filed: Dec. 12, 1983

[51] Int. Cl.[4] ..... F04D 5/00

[52] U.S. Cl. ..... 415/53 R; 415/54; 415/168; 415/219 R

[58] Field of Search ..... 415/53 R, 219 B, 143, 415/168, 108, 11, 54, 59, 169 A, 198.1, 213 B, 169 R, 219 R

[56] References Cited

U.S. PATENT DOCUMENTS

| | | | |
|---|---|---|---|
| 2,061,521 | 11/1936 | Saxe | 415/11 |
| 2,207,317 | 7/1940 | Gear | 415/53 |
| 2,228,207 | 1/1941 | Forssell | 415/198.1 |
| 2,244,397 | 6/1941 | La Bour | 415/53 R |
| 2,247,709 | 7/1941 | La Bour | 415/53 R |
| 2,291,478 | 7/1942 | La Bour | 415/219 B |
| 2,477,079 | 7/1949 | Mueller | 415/11 |
| 2,496,870 | 2/1950 | Granberg | 415/11 |
| 2,949,859 | 8/1960 | Granberg | 415/198.1 |
| 2,951,449 | 9/1960 | Van Blarcom, Jr. et al. | 415/53 R |
| 3,068,802 | 12/1962 | Costello et al. | 415/11 |
| 3,322,071 | 5/1967 | Teter | 415/53 R |
| 3,323,465 | 6/1967 | Stillebroer | 415/53 R |

FOREIGN PATENT DOCUMENTS

| | | | |
|---|---|---|---|
| 0604809 | 9/1960 | Canada | 415/53 R |
| 1253329 | 1/1961 | France | 415/53 R |
| 44-5728 | 12/1969 | Japan | 415/53 R |

*Primary Examiner*—Robert E. Garrett
*Assistant Examiner*—John Kwon
*Attorney, Agent, or Firm*—Cushman, Darby & Cushman

[57] ABSTRACT

A self-priming impeller type pump, particularly a centrifugal pump, is constructed so that the pump size and priming cycle time can be minimized. An impeller rotates about a generally horizontal axis within a housing having an inlet, with a diffuser portion of the housing adjacent the periphery of the impeller and defining a number of outlets. A front shroud of the impeller, adjacent the inlet, has external vanes which separate air from incoming liquid, and also facilitate recirculation of liquid from an outlet, to a recirculating liquid reservoir, and through a number of ports formed in the housing and extending generally parallel to the axis of rotation of the impeller. An air shield may be provided at the bottom of the housing to prevent air separated by diffuser peelers from passing to the recirculating ports. A reversing deflector is provided at the discharge from the topmost outlet to facilitate separation of air from liquid.

10 Claims, 2 Drawing Figures

SELF-PRIMING DIFFUSER TYPE CENTRIFUGAL PUMP

BACKGROUND AND SUMMARY OF THE INVENTION

There are many applications that call for a pump to be self-priming, i.e., where the level of liquid to be pumped is below the pump inlet. Typically, priming of a pump is accomplished utilizing a separate priming chamber and a vacuum pump, or the like, or when self-priming is accomplished normally a check valve is utilized at the foot of the suction line and/or in the pump itself, or an internal valve in a priming chamber.

According to the present invention, a self-priming type pump is provided that can be considerably smaller than conventional self-priming pumps, and/or can have a significantly shorter priming cycle time. The pump according to the invention also may be considered simplier than many conventional self-priming pumps, no valves being associated therewith. The pump according to the invention utilizes particular static components, and particular a cooperation between static components and rotating impeller, to effect separation of air from the liquid, and prevent return of separated air to the liquid inlet, or liquid recirculating ports.

The pump according to the invention includes a housing with an impeller mounted within the housing for rotation about an axis of rotation. Preferably, the pump comprises a centrifugal pump (that is, the liquid inlet is inline with the axis of rotation of the impeller, and the liquid outlet or outlets are radially spaced from, and in a dimension generally perpendicular to, the impeller axis of rotation), although in some embodiments the pump may comprise other types of impeller pumps, such as a rotary pump. Preferably, the axis of rotation of the impeller is generally horizontal, and a recirculating liquid reservoir is defined below the axis of rotation.

The housing includes means defining at least one, and preferably a plurality, of liquid recirculating ports below the axis of rotation of the impeller, and extending generally parallel to the axis of rotation. An air shield is provided on that portion of the housing adjacent an outlet below the axis of rotation, to prevent recirculating of air discharged through the outlet to the liquid recirculating ports. A drain hole is also provided in the housing at the bottom thereof, radially outwardly from the impeller.

The outlets from the housing are defined by diffusers, and each diffuser includes a peeler (sometimes known as a trimmer or a volute tongue) for effectively deflecting air bubbles out the discharge. At an outlet above the axis of rotation, a reversing deflector is associated with the outlet. The reversing deflector deflects the discharged liquid with entrained air so that it is essentially reversed in direction, and this deflection facilitates the separation of air entrained in the liquid from the liquid, the air having a tendency to then go upwardly and pass out of the system, while the liquid can pass to the recirculating liquid reservoir during the self-priming action.

Preferably, the impeller includes a front shroud at the portion thereof adjacent the inlet, the front shroud having a plurality of external vanes formed thereon. The vanes serve to facilitate separation of air from the liquid flowing into the inlet, and at the same time effect positive recirculating of liquid from the recirculating liquid reservoir through the recirculating ports.

It is the primary object of the present invention to provide a simple, efficient, and effective self-priming pump, particularly a self-priming centrifugal pump. This and other objects of the invention will become clear from an inspection of the detailed description of the invention, and from the appended claims.

DETAILED DESCRIPTION OF THE DRAWINGS

Figure 1:
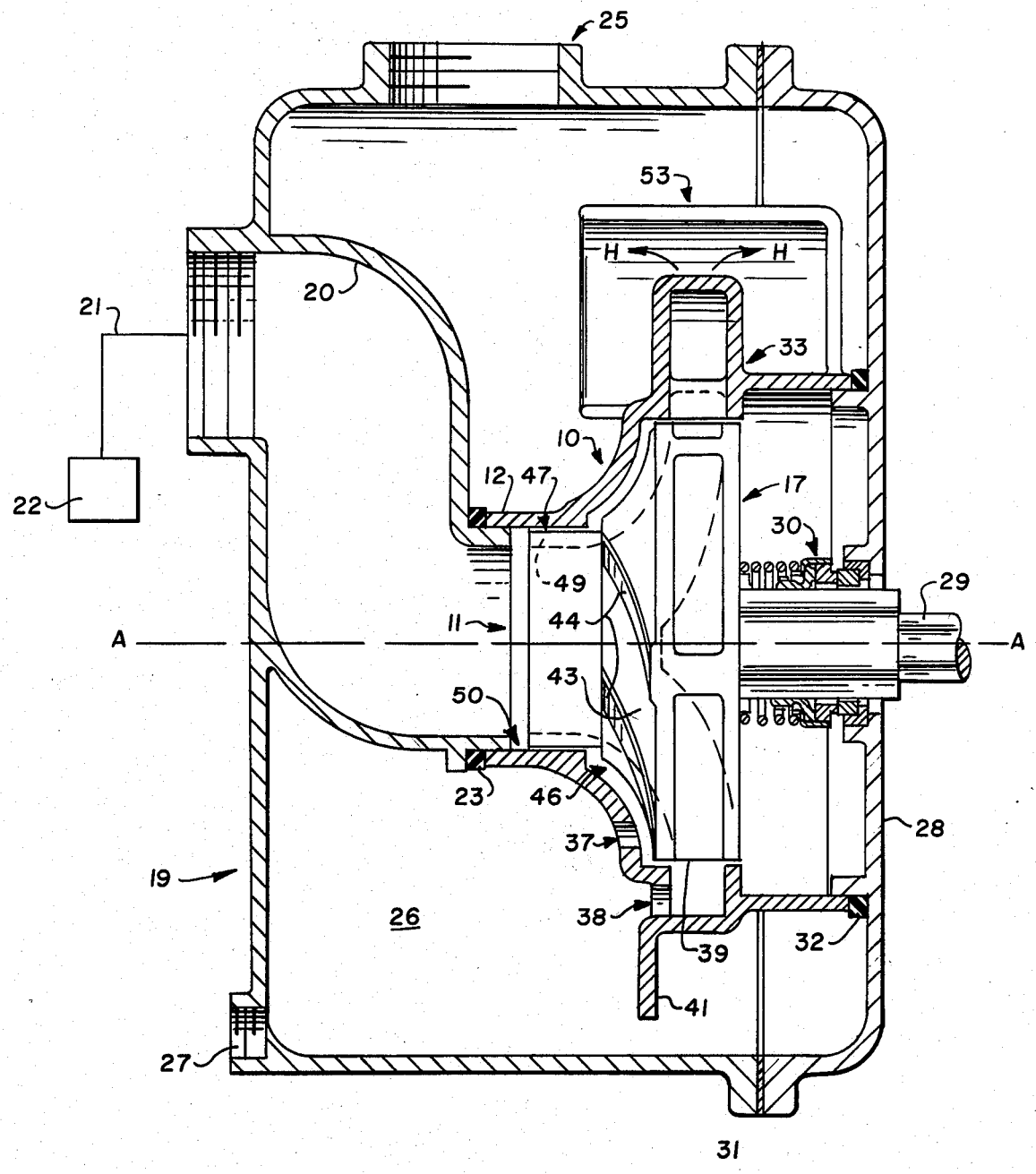
FIG. 1 is a side view, partly in cross section and partly in elevation, of an exempliary self-priming centrifugal pump according to the present invention.
Figure 2:
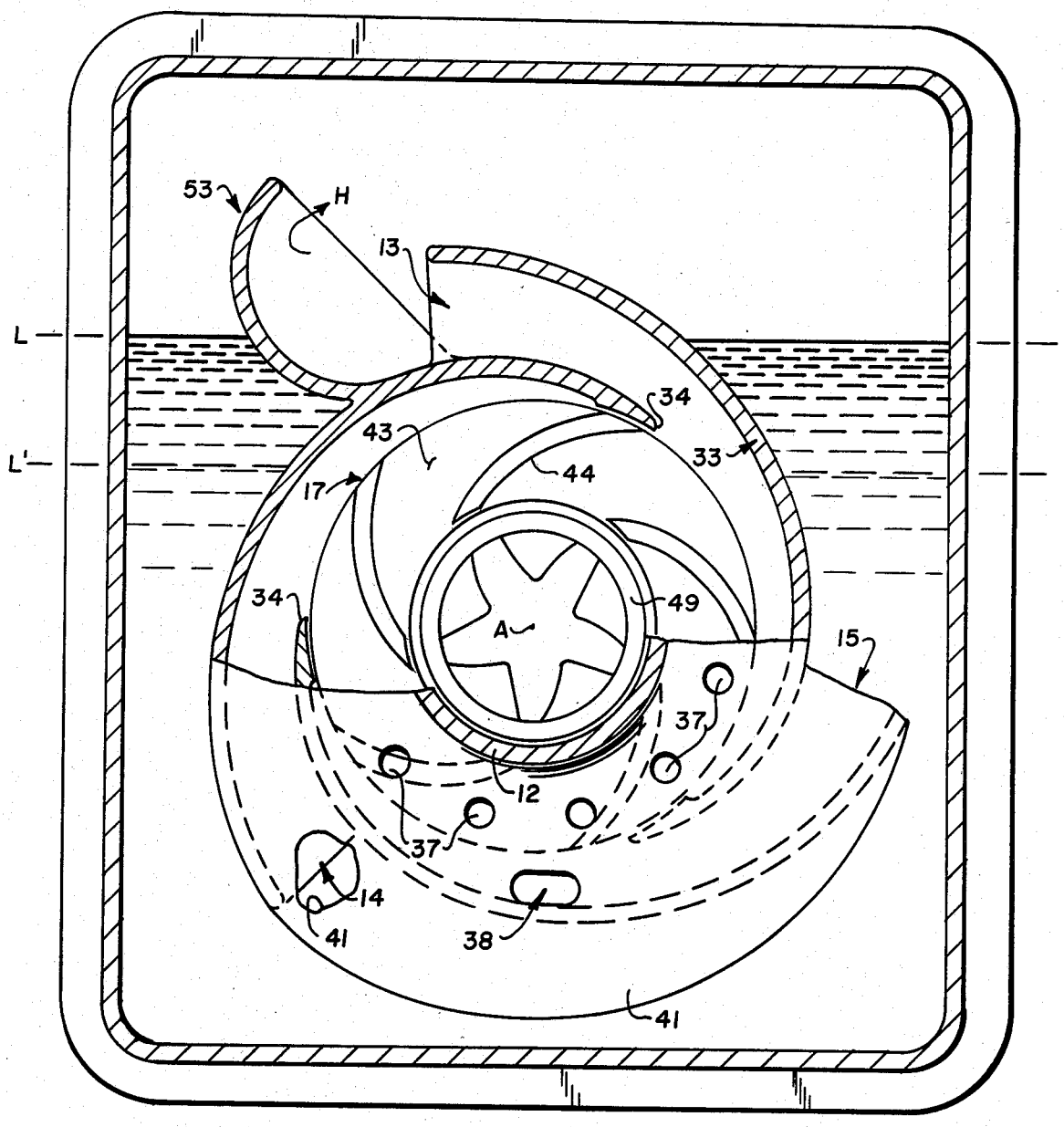
FIG. 2 is an end view, partly in cross section and partly in elevation, of the pump of FIG. 1.

The pump according to the present invention includes a housing, shown generally by reference numeral 10 in FIG. 1, the housing including an inlet 11 defined by a tubular inlet portion 12, and at least one—and preferably a plurality of—outlets (see outlets 13, 14, and 15 in FIG. 2). Mounted for rotation within the housing 10 about an axis of rotation A—A is an impeller 17.

The housing 10 and impeller 17 are preferably mounted within an external casing shown generally by reference numeral 19. This casing includes an inlet pipe 20 which interconnects the inlet tube 12 of pump housing 10 and a pipe shown schematically at 21, which pipe 21 is interconnected with the source of liquid 22 to be pumped. A gasket 23 preferably comprises a seal between the pipe 20 and tube 12.

The casing 19 includes a discharge opening 25 from which the liquid pumped by the impeller 17 is ultimately discharged, and through which air passes during the self-priming operation. The axis A—A will typically be generally horizontal, with the discharge 25 above the axis A—A. Below the axis A—A, the casing 19 defines a recirculating liquid reservoir 26 (see FIG. 1), and preferably a drain 27—which is normally closed with a drain plug (not shown)—is provided at the bottom of the reservoir 26.

The casing 19 also includes a wall 28 which includes means for mounting the shaft 29 of the impeller 17 for rotation about the axis A—A. Any typical conventional mounting means may be provided, such as the shaft seal and bearing means indicated generally by reference numeral 30 in FIG. 1. The wall 28 may be mounted so that it is detachable from the rest of the casing for easy replacement and repair of the impeller 17, with a gasket 31 being provided between the wall 28 and the rest of the housing 19. Also, a gasket 32 preferably seals between the diffuser 33 and the wall 28.

The diffuser 33 comprises the portion of the housing 10 defining the outlets 13, 14, 15. Associated with each outlet 13, 14, 15 of the diffuser 33 is a peeler 34 (see FIG. 2). A characteristic of impeller type pumps is that a substantial portion of air introduced into the pump tends to separate out and accumulate as a layer of air bubbles on the outer periphery of impeller 17. The peelers 34—sometimes known as trimmers or volute tongues—deflect air bubbles so that they pass through the outlets 13—15 so that they do not interfere with pumping of liquid by the impeller 17.

According to the present invention, means are provided defining at least one—and preferably a plurality of—liquid recirculating ports 37. These recirculating ports 37 provide for recirculation of liquid discharged through the openings 13—15 to the recirculating liquid reservoir 26, and back to the impeller 17, during self-priming action. As clearly evident in the drawings, these ports 37 are valveless. The ports 37 are disposed below the axis A—A in the housing 10, and are dimensioned and positioned (both radially and with respect to each other) so as to achieve the desired proper circulation of liquid through the impeller 17 for successful self-priming. Preferably, means are provided defining a drain opening 38 at the bottommost portion of the housing 10 adjacent—and radially spaced from—the periphery 39 of impeller 17. The drain opening 38 also functions as a liquid recirculating port during self-priming.

Located at the very bottom of the housing 10 with portions thereof even below the drain opening 38, is an air shield 41. The air shield 41 extends from the outlet 14 to the outlet 15, and as can be seen from the drawings prevents recirculation of air intermixed with the liquid discharged from outlet 14 to the ports 37, 38.

The impeller 17 includes a front shroud 43. The front shroud 43 includes a plurality of external vanes 44 disposed thereon, the vanes 44 being effective to separate some of the air from the liquid flowing through the inlet 11 and passing it to the periphery 39 of the impeller 17, and the vanes 44 also being effective to provide a pumping force for positively effecting circulation of liquid from the liquid reservoir 26 through the ports 37. Note that the housing 10 is constructed adjacent the shroud 43—as indicated by the reference numeral 46—to allow air passage, and a small air passageway 47 is provided between the interior of the housing 10 and the tubular leading end 49 of the shroud 43. Air collects in the gap 50 between the pipe 20 and the tubular leading end 49 of the shroud 43, and then passes through the passageways 47, 46 under the influence of the rotating vanes 44.

In order to facilitate separation of air entrained in liquid from the liquid during the self-priming action, a reversing deflector means 53 is also provided. The reversing deflector means 53 causes the flow of liquid—with entrained air—from outlet 13 to be deflected and essentially reversed, as illustrated by the arrows H in FIGS. 1 and 2—with the result that liquid falls down to the recirculating liquid reservoir 26, while the air passes upwardly out of the discharge opening 25.

Operation

At pump start up, the engine shaft 29 is rotated, which in turn effects rotation of the impeller 17 and provides a suction source sucking liquid and air from source 22 through line 21 to pipe 20. A part of the air entering pipe 20, and inlet 11 to the pump housing 10, passes through space 50 and gaps 46, 47 under the influence of the rotating external vanes 44, is ultimately separated by a peeler 34, and passes with liquid out one of the outlets 13-15. Air passing out outlet 14 is prevented—by air shield 41—from recirculating to ports 37, 38. Air passing out outlet 15 has a tendency to rise and pass out discharge 25, and air entrained with liquid passing out oulet 13 is separated from the liquid by deflector 53 and passes upwardly out of discharge 25.

During the priming operation, liquid which passes out the outlets 13-15 collects in the recirculating liquid reservoir 26, in which there normally is maintained liquid at a level L (see FIG. 2), with a minimal level of L'. This liquid is recirculated through ports 37, 38, particularly under the influence of vanes 44, and is continuously pumped. The small clearance between the periphery 39 of the impeller 17 and the interior of the diffuser 33 provides a dynamic liquid seal in the form of a moving ring of water, which seal prevents air from returning to the pump suction, and thus in a relatively short period of time all of the air is purged from the system and the pump is primed. The pump then continues pumping liquid out of discharge 25.

It will thus be seen that according to the present invention, a simple—yet effective —self-priming impeller-type pump is provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A self-priming centrifugal pump comprising:
a housing having an inlet and an outlet;
an impeller mounted for rotation about a generally horizontal axis of rotation, and within said housing;
means defining a liquid reservoir adjacent said housing and in operative association with said impeller, said liquid reservoir separated from said housing liquid inlet so that no operative communication between said reservoir and said inlet is provided, and said reservoir is in operative communication with an outlet from said housing;
means defining at least one liquid-circulating valveless port in said housing adjacent said impeller for providing effective recirculation of liquid from said liquid reservoir to said impeller for successful priming of said pump; and
air shield means disposed between a housing outlet and said recirculating ports below said axis of rotation, and for preventing air discharge from said housing outlet from passing to said liquid recirculating ports, so that air laden water is kept separate from the liquid in said reservoir wherein said impeller includes a front shroud at a portion thereof closest to said housing inlet; and further comprising external vane means disposed on said impeller front shroud for effecting separation of air flowing with liquid through said housing inlet, and for effecting circulation of liquid from said liquid reservoir through said valveless port.

2. A pump as recited in claim 1 wherein said means defining at least one valveless recirculating port comprise means defining a plurality of valveless recirculating ports.

3. A pump as recited in claim 2 wherein said recirculating ports are disposed below said axis of rotation.

4. A pump as recited in claim 3 further comprising means defining a drain opening in said housing at a bottom portion thereof spaced radially outwardly from said impeller.

5. A pump as recited in claim 3 further comprising a diffuser with a plurality of vanes and peeler means, the periphery of said impeller being disposed with respect to said diffuser so that a dynamic seal in the form of a moving ring of water is maintained between the periphery of the impeller and the diffuser during rotation of the impeller, said seal preventing air from returning to the housing inlet.

6. A pump as recited in claim 1 further comprising a housing outlet above said axis of rotation; and reversing deflector means disposed in operative association with said housing outlet above said axis of rotation for facilitating separation of air from liquid discharged through said housing outlet, and for preventing air laden water from re-entering said reservoir.

7. A pump as recited in claim 1 further comprising a diffuser with a plurality of peeler means, the periphery of said impeller being disposed with respect to said diffuser so that a dynamic seal in the form of a moving ring of water is maintained between the periphery of the impeller and the diffuser during rotation of the impeller, said seal preventing air from returning to the housing inlet.

8. A pump as recited in claim 1 further comprising means defining a plurality of liquid recirculating openings extending through said housing in a dimension generally parallel to the axis of rotation of said impeller, and radially spaced from said axis of rotation and adjacent said external vanes near the periphery of said impeller.

9. A self-pumping pump comprising:

a housing having an inlet and an outlet;

an impeller mounted for rotation about a generally horizontal axis of rotation, and within said housing;

means defining a liquid reservoir adjacent said housing and in operative assocation with said impeller, said liquid reservoir separated from said housing liquid inlet so that no operative communication between said reservoir and said inlet is provided, and said reservoir is in operative communication with a discharge from said housing;

means defining at least one liquid-circulating valveless port in said housing adjacent said impeller for providing effective recirculation of liquid from said liquid reservoir to said impeller for successful priming of said pump;

a housing outlet above said axis of rotation;

reversing deflector means disposed in operative association with said housing outlet above said axis of rotation for facilitating separation of air from liquid discharged through said housing outlet, and for preventing air laden water from reentering said reservoir;

said impeller including a front shroud disposed adjacent said inlet including a plurality of external vanes formed on said pump shroud; and means defining a small air passageway between the interior of said housing and said front shroud so that any air that collects in a gap between said front shroud and said housing is caused to flow out said outlet by the action of said external vanes wherein said air shield means comprises a plate having an arcuate shape, and disposed as a continuation of one portion of a wall member defining a housing outlet, said plate extending substantially vertically within said housing wherein said impeller includes a front shroud disposed adjacent said inlet; and further comprising means defining a small air passageway between the interior of said housing and said front shroud so that any air that collects in a gap between said front shroud and said housing is caused to flow out said outlet by the action of said impeller.

10. A pump as recited in claim 9 further comprising a plurality of external vanes formed on said pump shroud and acting on air that collects in said gap to cause it to flow out said outlet.

* * * * *